US008593365B2

(12) United States Patent
Moon et al.

(10) Patent No.: US 8,593,365 B2
(45) Date of Patent: Nov. 26, 2013

(54) METHOD FOR INSTALLING RADIATOR ELEMENTS ARRANGED IN DIFFERENT PLANES AND ANTENNA THEREOF

(75) Inventors: Young-Chan Moon, Suwon-si (KR); Oh-Seog Choi, Hwaseong-si (KR); Sung-Hwan So, Hwaseong-si (KR); In-Ha Jung, Anyang-si (KR); Seung-Mok Han, Busan (KR)

(73) Assignee: KMW Inc, Yeongcheon-ri, Dongtan-myeon, Hwaseong-si, Gyeonggi-do (KR)

( * ) Notice: Subject to any disclaimer, the term of this patent is extended or adjusted under 35 U.S.C. 154(b) by 308 days.

(21) Appl. No.: 12/948,014

(22) Filed: Nov. 17, 2010

(65) Prior Publication Data

US 2011/0175784 A1 Jul. 21, 2011

(30) Foreign Application Priority Data

Nov. 17, 2009 (KR) ..... 10-2009-0110696

(51) Int. Cl.
*H01Q 21/00* (2006.01)
*H01Q 21/26* (2006.01)

(52) U.S. Cl.
USPC ..... 343/816; 343/798

(58) Field of Classification Search
USPC ..... 343/725, 797, 798, 810, 812, 815–818
See application file for complete search history.

(56) References Cited

U.S. PATENT DOCUMENTS

| | | | | |
|---|---|---|---|---|
| 5,801,600 | A | 9/1998 | Butland et al. | |
| 5,877,660 | A | 3/1999 | Ebine et al. | |
| 6,188,373 | B1 | 2/2001 | Martek | |
| 6,333,720 | B1 * | 12/2001 | Gottl et al. | 343/810 |
| 6,339,407 | B1 * | 1/2002 | Gabriel et al. | 343/797 |
| 6,831,615 | B2 * | 12/2004 | Gottl | 343/797 |
| 7,068,222 | B2 * | 6/2006 | Koparan et al. | 343/700 MS |
| 7,079,083 | B2 * | 7/2006 | Gottl et al. | 343/797 |
| 2003/0011529 | A1 | 1/2003 | Gottl | |
| 2005/0134403 | A1 | 6/2005 | Kajiya | |
| 2006/0114168 | A1 | 6/2006 | Gottl et al. | |

FOREIGN PATENT DOCUMENTS

| | | | |
|---|---|---|---|
| EP | 1544944 | A2 | 6/2005 |
| EP | 1739848 | A1 | 1/2007 |
| JP | 56-7502 | A | 1/1981 |
| JP | 7-288418 | A | 10/1995 |
| JP | 11-330848 | A | 11/1999 |
| JP | 2004-056643 | A | 2/2004 |
| KR | 20-1993-0020441 | | 9/1993 |
| KR | 10-2002-0073212 | A | 9/2002 |
| KR | 2005-0088753 | | 9/2005 |
| KR | 2006-0104786 | | 10/2006 |
| KR | 2007-0083723 | | 8/2007 |
| WO | WO 99/59223 | * | 11/1999 |
| WO | 03/065505 | A1 | 8/2003 |
| WO | 2008/136408 | A1 | 11/2008 |

* cited by examiner

*Primary Examiner* — Hoang V Nguyen
(74) *Attorney, Agent, or Firm* — Cha & Reiter, LLC

(57) ABSTRACT

A method for installing radiator elements arranged on different planes and an antenna having the radiator elements are provided, in which a first-position radiator element is placed on one plane, a second-position radiator element is placed on another plane, and power supply cables are connected to the first-position radiator element and the second-position radiator element. The power supply cables are designed to compensate for a phase difference between signals radiated in the air from the first-position radiator element and the second-position radiator element by a phase difference between signals propagated via the power supply cables.

12 Claims, 6 Drawing Sheets

METHOD FOR INSTALLING RADIATOR ELEMENTS ARRANGED IN DIFFERENT PLANES AND ANTENNA THEREOF

BACKGROUND OF THE INVENTION

1. Field of the Invention

The present invention relates to a method for installing radiator elements arranged on different planes and an antenna having the radiator elements.

2. Description of the Related Art

Extensive research has recently been conducted on small, lightweight antennas for use in Base Stations (BSs) or relays in a mobile communication system. A dual-band dual-polarization antenna is under development, in which a second radiator of a high frequency band (e.g. 2 GHz) is stacked on a first radiator element of a low frequency band (e.g. 800 MHz).

In such an antenna, for example, patch-type or dipole-type second radiator elements may be overlapped on patch-type first radiator elements. These stacked first and second radiator elements are arranged on a reflective plate at intervals to form a radiator element array of a first frequency band. In addition, second radiator elements are installed between the stacked first and second radiator elements on the reflective plate in order to form a radiator element array of a second frequency band. This layout contributes to antenna miniaturization and achieves antenna gain.

However, because the second radiator elements stacked on the first radiator elements and the independently installed second radiator elements are on different planes, a phase difference may be produced when a signal of the second frequency band is radiated.

To avert the problem, the independently installed second radiator elements may be installed high by means of an auxiliary device so that the independently installed second radiator elements are even with the second radiator elements stacked on the first radiator elements. However, this scheme adversely affects radiation of the first radiator elements of the first frequency band, thereby degrading radiation characteristics of a first frequency-band signal.

At present, therefore, a technique for narrowing the difference between the planes of the independently installed second radiator elements and the second radiator elements stacked on the first radiator elements is adopted, although affecting radiation of the first radiator elements of the first frequency band within an allowed range.

SUMMARY OF THE INVENTION

An aspect of embodiments of the present invention is to address at least the problems and/or disadvantages and to provide at least the advantages described below. Accordingly, an aspect of embodiments of the present invention is to provide a method for installing radiator elements arranged on different planes to narrow the phase difference between signals radiated from the radiator elements, and an antenna using the radiator elements.

Another aspect of embodiments of the present invention is to provide a method for installing radiator elements to improve radiation characteristics of second radiator elements without degrading radiation characteristics of first radiator elements in a dual-band antenna having second radiator elements of a second frequency band overlapped on first radiator elements of a first frequency band and independently installed second radiator elements of the second frequency band, and an antenna using the radiator elements.

In accordance with an embodiment of the present invention, there is provided an antenna having radiator elements arranged on different planes, in which a first-position radiator element is placed on one plane, a second-position radiator element is placed on another plane, and power supply cables are connected to the first-position radiator element and the second-position radiator element. Lengths of the power supply cables are determined to compensate for a phase difference between signals radiated in the air from the first-position radiator element and the second-position radiator element by a phase difference between the power supply cables according to a position difference between the planes on which the first-position radiator element and the second-position radiator elements are placed.

In accordance with another embodiment of the present invention, there is provided a method for installing radiator elements arranged on different planes, in which a phase difference between signals radiated in the air from the radiator elements arranged on the different planes is calculated according to a position difference between installation planes of the radiator elements, and power supply cables connected to the radiator elements arranged on the different planes are designed, so that the power supply cables has a phase difference compensating for a phase difference between the signals radiated in the air from the radiator elements.

In accordance with a further embodiment of the present invention, there is provided an antenna in which a first radiator element is placed at a first position on one plane, a second radiator element is placed at a second position on another plane, and power supply cables are connected to the first radiator element and the second radiator element. A first signal radiated from the first radiator element has a phase difference from a second signal radiated from the second radiator element and a length of one of the power supply cables is determined to compensate for the phase difference.

BRIEF DESCRIPTION OF THE DRAWINGS

The above and other objects, features and advantages of certain embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EMBODIMENTS OF THE INVENTION

Figure 1:
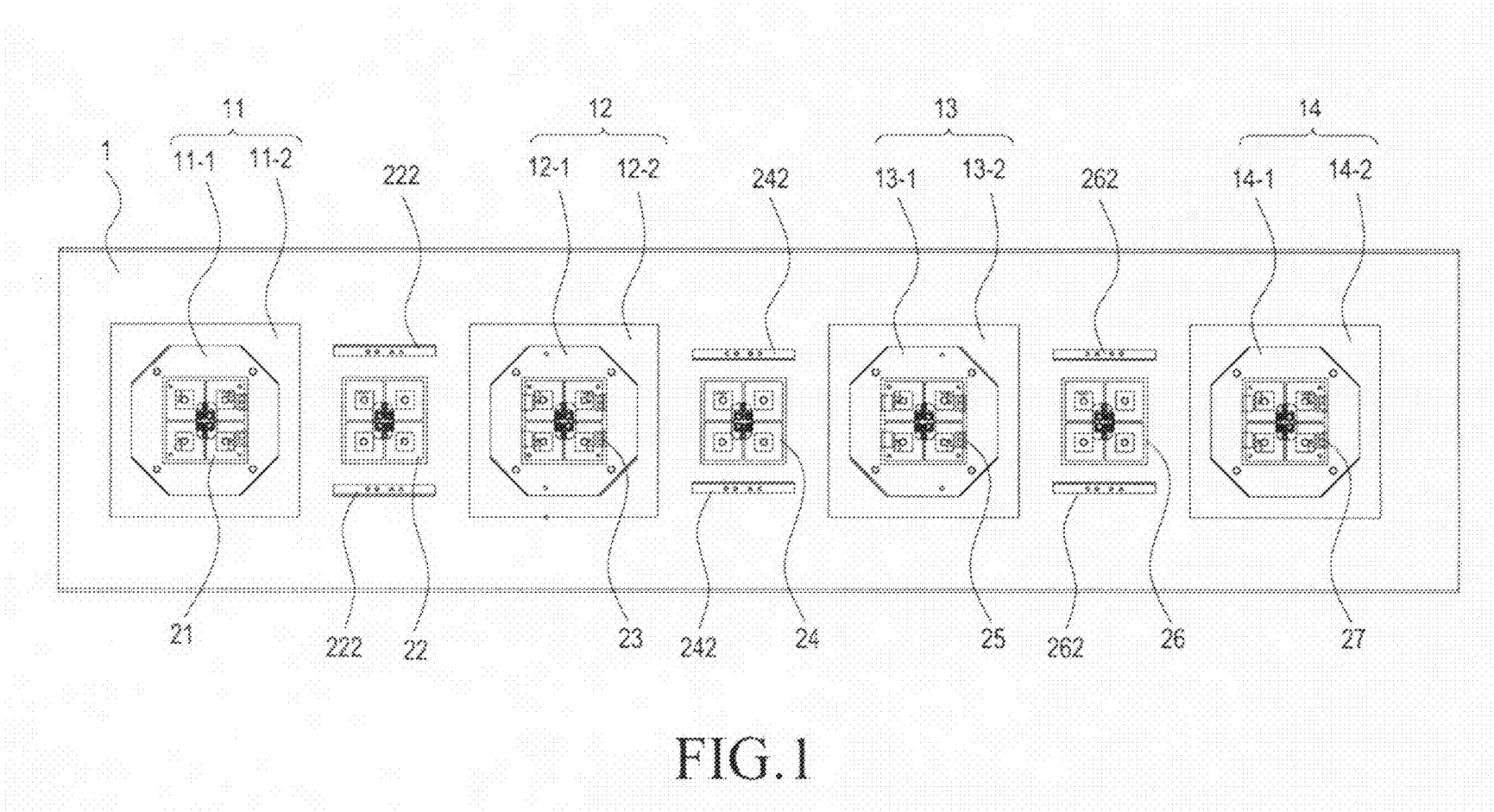
FIG. 1 is a plane perspective view of a mobile communication Base Station (BS) antenna having radiator elements arranged on different planes according to an embodiment of the present invention.

Reference will now be made in detail to the preferred embodiments of the present invention with reference to the accompanying drawings. Like reference numerals denote the same elements across the specification.

Figure 2:
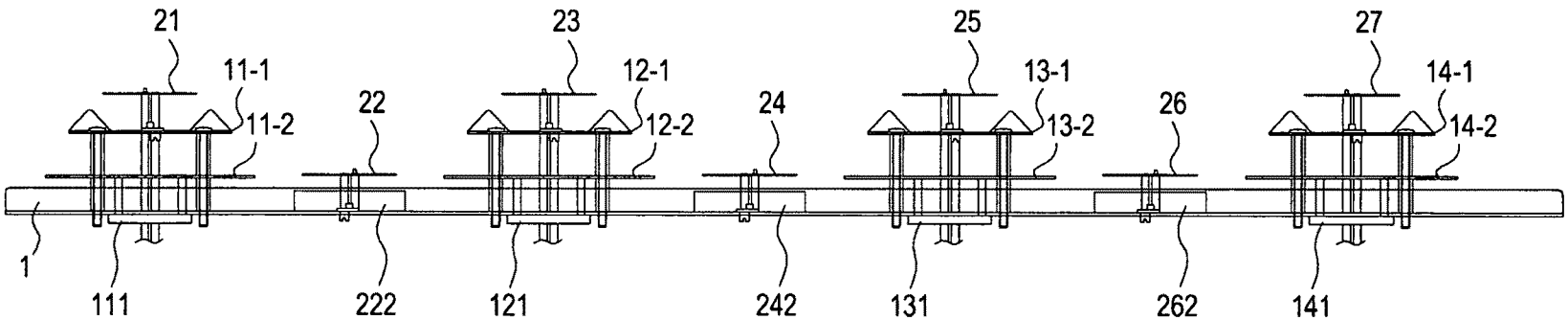
FIG. 2 is a side perspective view of the mobile communication BS antenna illustrated in FIG. 1.
Figure 3:
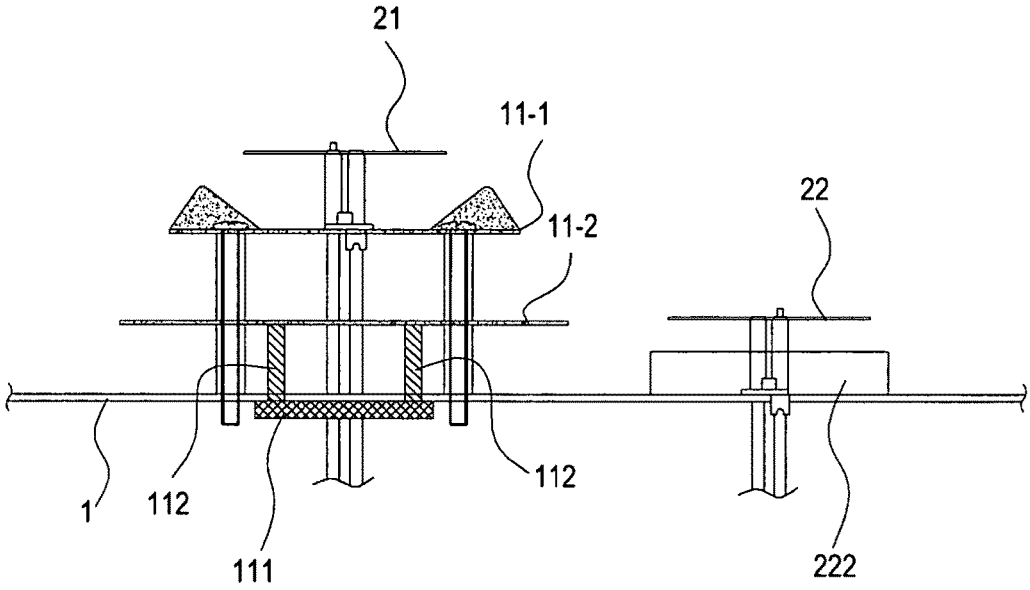
FIG. 3 is a partial enlarged view of the mobile communication BS antenna illustrated in FIG. 2.

FIG. 1 is a plane perspective view of a mobile communication Base Station (BS) antenna having radiator elements arranged on different planes according to an embodiment of the present invention, FIG. 2 is a side perspective view of the mobile communication BS antenna illustrated in FIG. 1, and FIG. 3 is a partial enlarged view of the mobile communication BS antenna illustrated in FIG. 2. Referring to FIGS. 1, 2 and 3, an antenna according to an embodiment of the present invention includes patch-type first radiator elements 11, 12, 13 and 14 that operate in a first frequency band (e.g. 800 MHz). The first radiator elements 11, 12, 13 and 14 are arranged at a predetermined interval on a top surface of a reflective plate 1. In addition, dipole-type second radiator elements 21, 22, 23, 24, 25, 26 and 27 are stacked on the first radiators 11, 12, 13 and 14 or interposed between the first radiators 11, 12, 13 and 14 directly on the top surface of the reflective plate 1.

Each of the first radiator elements 11, 12, 13 and 14 includes a top patch plate 11-1, 12-1, 13-1 or 14-1 and a bottom patch plate 11-2, 12-2, 13-2 or 14-2. The bottom patch plates 11-2, 12-2, 13-2 and 14-2 are connected to Printed Circuit Boards (PCBs) 111, 121, 131 and 141 attached on a rear surface of the reflective plate 1 via auxiliary power supply cables 112 that pass through the reflective plate 1.

As illustrated in FIGS. 1, 2 and 3, the second radiator elements 22, 24 and 26 installed between the first radiators 11 to 14 directly on the top surface of the reflective plate 1 may be even with or lower than the first radiator elements 11 to 14 in the antenna according to the embodiment of the present invention. Thus the second radiator elements 22, 24 and 26 may be designed to minimize influence on radiation of the first radiator elements 11 to 14.

Figure 4:
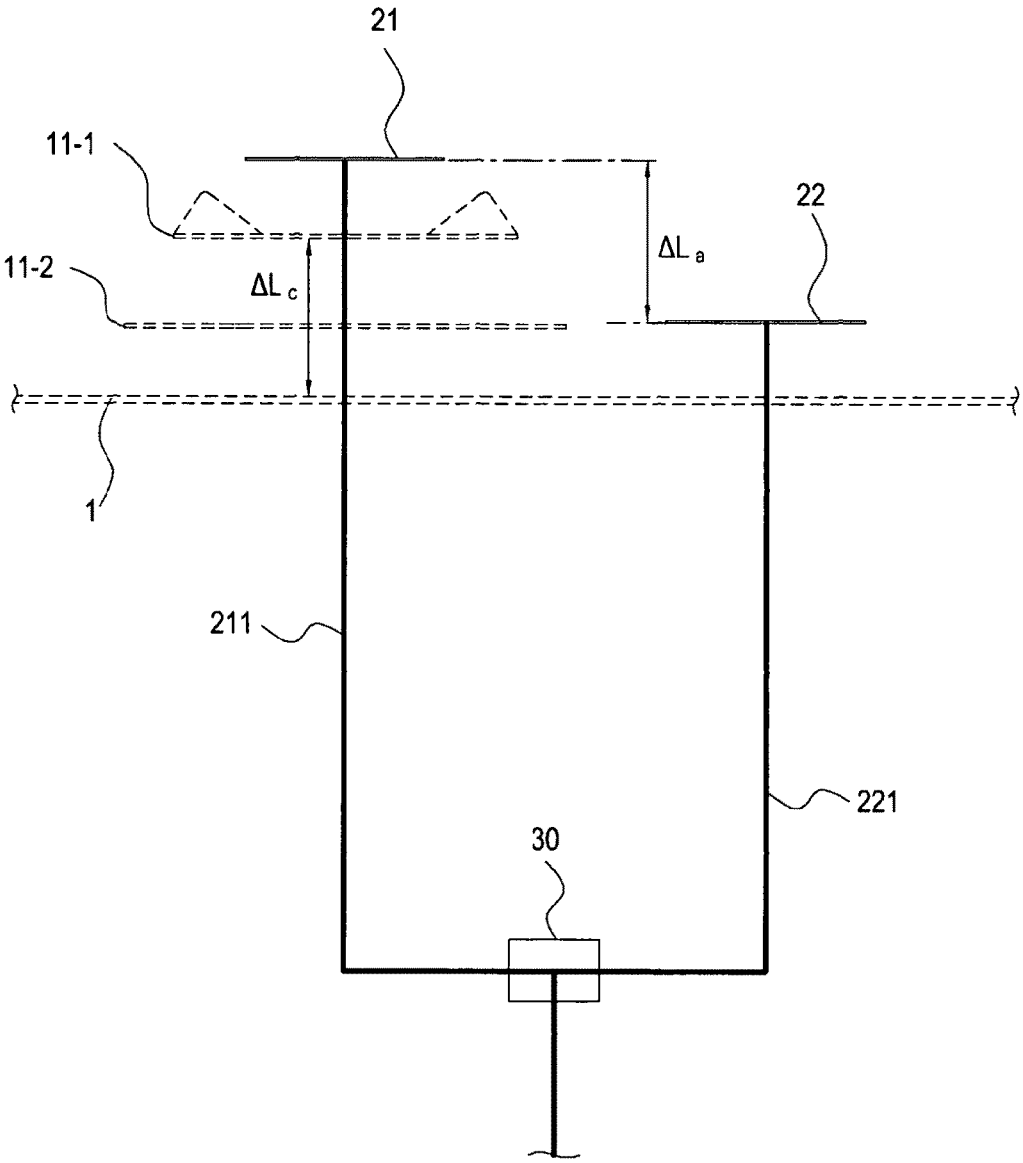
FIG. 4 is a schematic view of a power supply network installed at second radiator elements illustrated in FIG. 1.

In this structure, the installation plane of the second radiator elements 21, 23, 25 and 27 stacked on the first radiator elements 11 to 14 is very different in height from the installation plane of the second radiator elements 22, 24 and 26 directly installed on the reflective plate 1. Therefore, power supply cables connected to the high second radiator elements 21, 23, 25 and 27 stacked on the first radiator elements 11 to 14 and the low second radiator elements 22, 24 and 26 installed directly on the reflective plate 1 are designed to have lengths that may compensate for a phase difference between signals propagated over the air, caused by the height difference between the radiator elements with a phase difference between signals propagated through the power supply cables. With reference to FIG. 4, a method for compensating for the phase difference between radiator elements on different installation planes according to the present invention will be described in detail.

FIG. 4 is a schematic view of a power supply network installed at the second radiator elements illustrated in FIG. 1. Referring to FIG. 1, the high second radiator element 21 and the low second radiator element 22 receive signals divided by a divider 30 through power supply cables 211 and 221, respectively.

If the two power supply cables 211 and 221 are equally long, the phase difference between signals radiated from the second radiator elements 21 and 22 may be equal to the phase difference between signals propagated over the air, caused by the height difference ΔL between the second radiator elements 21 and 22. That is, the phase of the signal radiated from the low second radiator element 22 is delayed to some extent, compared to the phase of the signal radiated from the high second radiator element 21.

Accordingly, the present invention compensates for the phase delay of the signal radiated from the low second radiator element 22 using the power supply cable 221. Specifically, the power supply cable 221 of the low second radiator element 22 is designed to have a length that makes the phase of the signal radiated from the second radiator element 22 through the power supply cable 221 equal to the phase of the signal radiated from the second radiator element 21 through the power supply cable 211, according to the phase delay. As a consequence, the signals radiated from the two second radiator elements 21 and 22 have no phase difference, for example, from the perspective of the installation plane of the high second radiator element 21.

The phase difference Δρ from the signal radiated from the high second radiator element 21 to the signal radiated from the low second radiator element 22 may be computed by $$\Delta\rho = \beta c\Delta L_c - \beta a\Delta L_a = \frac{2\pi}{\lambda}\sqrt{\xi r}\,\Delta L_c - \frac{2\pi}{\lambda}\Delta L_a \tag{1}$$

where $\beta c\Delta L_c$ denotes the phase difference between the power supply cables. βc represents the propagation constant of a power supply cable and $\Delta L_c$ represents the length difference between the power supply cables. $\beta a\Delta L_a$ denotes the phase difference between signals over the air, caused by the height difference between the two radiator elements. βa is the propagation constant of the air and $\Delta L_a$ is a distance difference in the air (that is, the height difference between the installation planes of the two radiator elements).

Because the propagation constant of a specific medium is (2π×(medium transmission rate))/(wavelength of frequency), the equation of the first row is expressed as the equation of the second row in equation (1). Here, $\sqrt{\in r}$ is the dielectric constant of a power supply cable and λ is a wavelength.

If the lengths of the two power supply cables 211 and 22 from the divider 30 to the reflective plate 1 on which the two radiator elements 21 and 22 are directly or indirectly installed are different by $\Delta L_c$ and the distance difference between the radiator elements 21 and 22 over the air is $\Delta L_a$, equation (1) may be expressed as equation (2).

$$\Delta\rho = \frac{2\pi}{\lambda}\left(\sqrt{\xi r} - 1\right)\Delta L \tag{2}$$

According to the present invention, the phase difference Δρ from the signal radiated from the high second radiator element 21 to the low second radiator element 22 should be 0. Therefore, the height difference between the installation planes of the two radiator elements 21 and 22 and/or the length difference between the power supply cables 211 and 221 are determined to satisfy $\beta c\Delta L_c - \beta a\Delta L_a = 0$. In actual fabrication, the two radiator elements 21 and 22 are installed and then the phase difference Δρ between the signals radiated from the radiator elements 21 and 22 is calculated using equation (2). Subsequently, the power supply cable 221 of the low second radiator element 22 is fabricated to a length that compensates for the phase difference Δρ according to information about a phase variation per a unit length of a prepared power supply cable.

Among the second radiator elements 21 to 27 that can be installed in the above manner, the second radiator elements 21, 23, 25 and 27 stacked on the first radiator elements 11 to 14 share the top patch plates 11-1, 12-1, 13-1 and 14-1 being the ground parts of the first radiator elements 11 to 14 in a relatively low frequency band, as the ground, whereas the second radiator elements 22, 24 and 16 share the same ground with the first radiator elements 11 to 14. Therefore, a ground size is relatively large and thus a horizontal beamwidth is narrow. To overcome this problem, corners of the top patch plates 11-1, 12-1, 13-1 and 14-1 of the first radiator elements 11 to 14 are spread or bent, and auxiliary side walls 222, 242 and 262 are formed.

Figure 5:
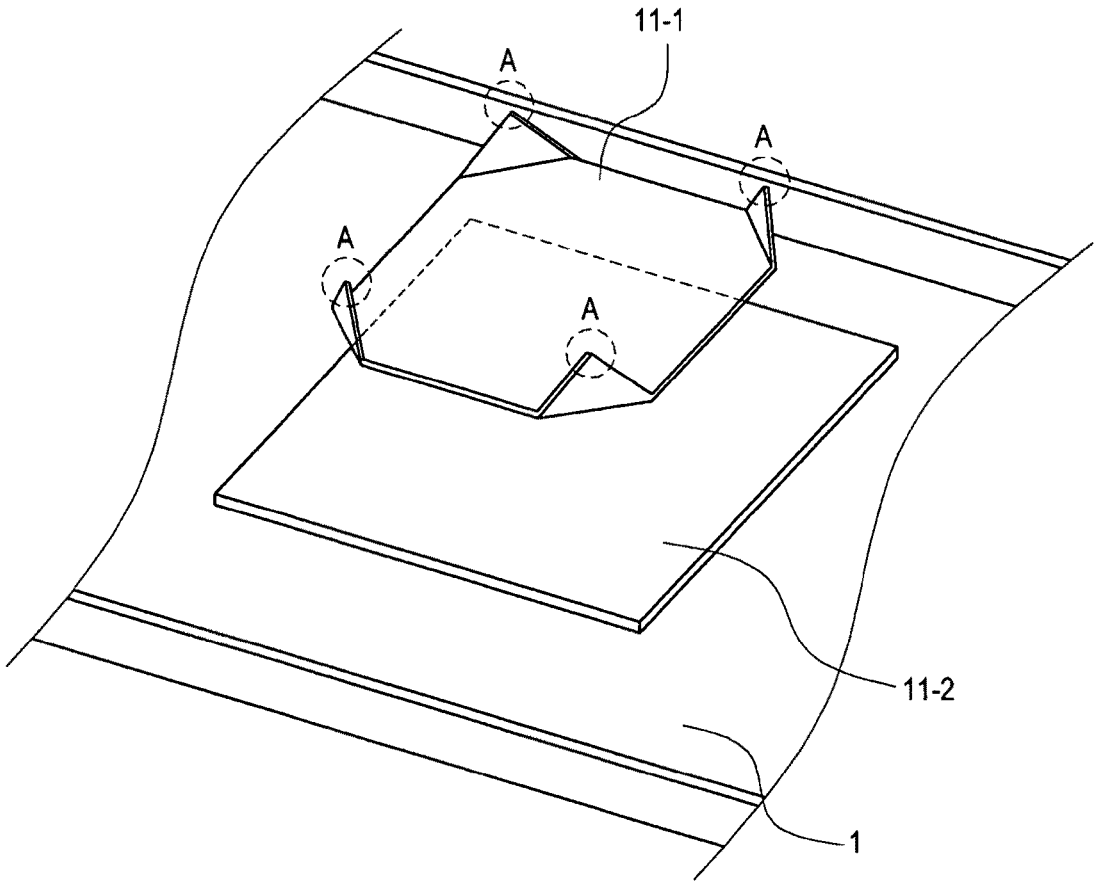
FIG. 5 is a perspective view of the patch structure of a first radiator element illustrated in FIG. 1.

FIG. 5 is a perspective view of the patch structure of a first radiator element illustrated in FIG. 1. For the sake of convenience, only the reflective plate 1 and the top and bottom patch plates 11-1 and 11-2 of one first radiator element are shown in FIG. 5. Corners A of the top patch plate 11-1 are bent.

For the same reason, the auxiliary side walls 222, 242 and 262 may be additionally formed on both sides of the second radiator elements 22, 24 and 26 installed directly on the reflective plate 1 to thereby facilitate designing of a horizontal beam to a desired beamwidth.

Figure 6A:
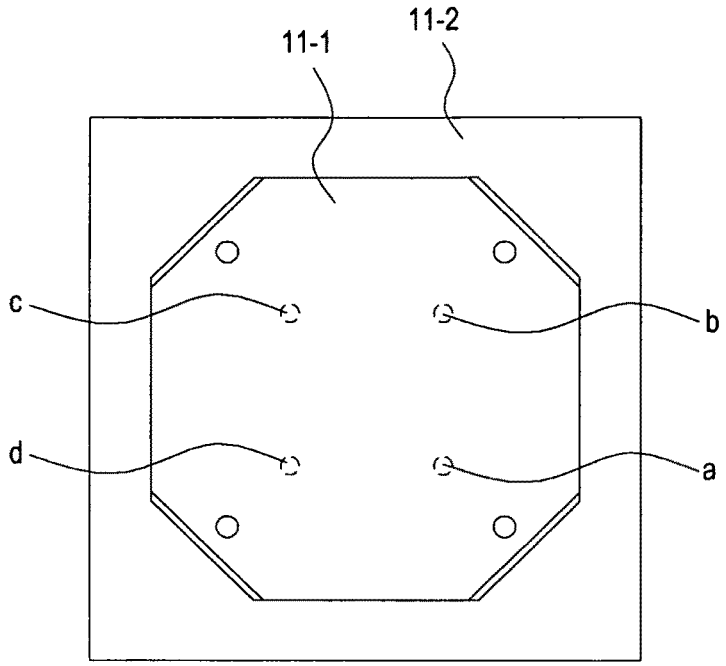
FIGS. 6A and 6B are a plane view and rear view of the power supply structure of a first radiator element illustrated in FIG. 1.
Figure 6B:
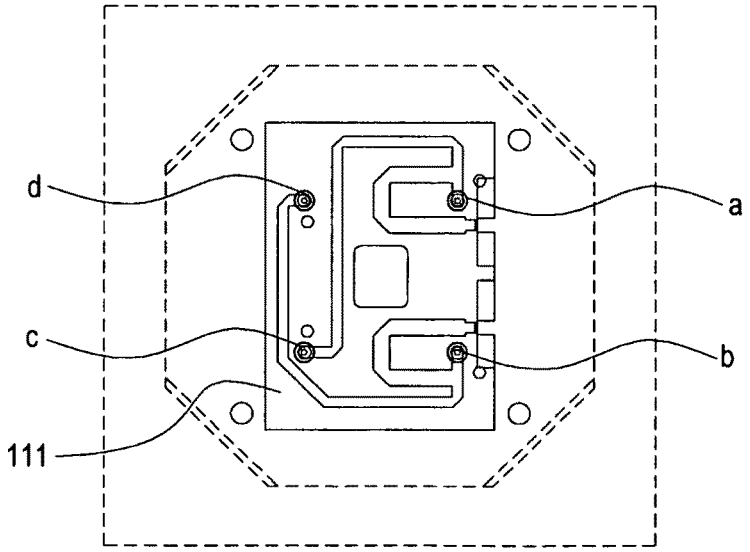

FIGS. 6A and 6B are a plane view and rear view of the power supply structure of a first radiator element illustrated in FIG. 1. For the sake of convenience, only the top and bottom patch plates 11-1 and 11-2 of one first radiator element and the PCB 111 having a power supply conductor pattern formed thereon are shown in FIGS. 6A and 6B.

Referring to FIGS. 3, 6A and 6B, the bottom patch plate 11-2 of the first radiator element 11 is connected to the PCBs 111, 121, 131 and 141 having power supply conductor patterns formed thereon, attached to the rear surface of the reflective plate 1 via the auxiliary power supply cables 112 passing through the reflective plate 1. That is, the power supply conductor pattern of the first radiator element 11 is printed on the PCB 111, and power supply points a to d of the PCB 111 are connected to power supply points a to d of the bottom patch plate 11-2 via the auxiliary power supply cables 112 in the antenna according to the present invention. Therefore, the circuit configuration is simplified.

As is apparent from the above description, the method for installing radiator elements according to the present invention can narrow the phase difference between signals radiated from radiator elements arranged on different planes. Especially in a dual-band antenna having second radiator elements of a second frequency band stacked on first radiator elements of a first frequency band and independently installed second radiator elements of the second frequency band, the present invention can improve the radiation characteristics of the second radiator elements, without degrading the radiation characteristics of the first radiator elements.

While the present invention has been particularly shown and described with reference to certain embodiments thereof, it will be understood by those of ordinary skill in the art that various changes in form and details may be made therein without departing from the spirit and scope of the present invention.

For example, while it has been described above that the first radiator elements are of a patch type and the second radiator elements are of a dipole type, the first and second radiator elements may all be of the patch type or the dipole type. In addition, while the present invention has been described in the context of a dual-band antenna having first and second radiator elements for first and second frequency bands, the present invention is applicable to all radiator elements arranged on different planes.

What is claimed is:

1. An antenna having radiator elements arranged on different planes, comprising:

a first-position radiator element placed at one plane;

a second-position radiator element placed at another plane; and power supply cables connected to the first-position radiator element and the second-position radiator element, wherein lengths of the power supply cables are configured to compensate for a phase difference between signals radiated in the air from the first-position radiator element relative to the second-position radiator element by a phase difference between the power supply cables according to a position difference between the planes at which the first-position radiator element and the second-position radiator elements are placed;

wherein a signal phase difference from the first-position radiator element to the second-position radiator element is calculated by subtracting a phase difference between the first-position radiator element and the second-position radiator element in the air from a phase difference between the first-position radiator element and the second-position radiator element on the power supply cables.

2. The antenna of claim 1, wherein the first-position radiator element and the second-position radiator element are of a dipole type or a patch type.

3. The antenna of claim 1, wherein the first-position radiator element or the second-position radiator element is stacked on a radiator element of another frequency band.

4. The antenna of claim 3, wherein the radiator element of another frequency band is a patch-type radiator element having a top patch plate and a bottom patch plate.

5. The antenna of claim 4, wherein the patch-type radiator element is installed on a top surface of a reflective plate of the antenna and the bottom patch plate of the patch-type radiator element is connected to a printed circuit board having a power supply conductor pattern formed thereon, attached to a rear surface of the reflective plate via an auxiliary power supply cable passing through the reflective plate.

6. The antenna of claim 1, wherein a signal phase difference $\Delta\rho$ from the first-position radiator element to the second-position radiator element is calculated using the following equation and the power supply cables are designed based on the signal phase difference $\Delta\rho$, $$\Delta\rho = \beta c\Delta L_c - \beta a\Delta L_a = \frac{2\pi}{\lambda}\sqrt{\xi r}\,\Delta L_c - \frac{2\pi}{\lambda}\Delta L_a \tag{1}$$

where $\beta c\Delta L_c$ denotes a phase difference between the first-position radiator element and the second-position radiator element on the power supply cables, $\beta c$ denotes a propagation constant of a power supply cable, $\Delta L_c$ denotes the length difference between the power supply cables, $\beta a\Delta L_a$ denotes a phase difference between the first-position radiator element and the second-position radiator element in the air, $\beta a$ denotes a propagation constant of the air, and $\Delta L_a$ denotes the position difference between the first plane and the second plane in the air.

7. The antenna of claim 1, wherein the first radiator element includes the second radiator element and a third radiator element and the second radiator element and the third radiator elements form a stack.

8. The antenna of claim 7, wherein the second radiator element is of a dipole type and the third radiator element is of a patch type.

9. The antenna of claim 8, wherein the length of the one of the power supply cables is determined by the following equation, $$\Delta\rho = \beta c\Delta L_c - \beta a\Delta L_a = \frac{2\pi}{\lambda}\sqrt{\xi r}\,\Delta L_c - \frac{2\pi}{\lambda}\Delta L_a \quad (3)$$

where $\beta c\Delta L_c$ denotes a phase difference between the power supply cables, $\beta c$ denotes a propagation constant of a power supply cable, $\Delta L_c$ denotes a length difference between the power supply cables, $\beta a\Delta L_a$ denotes a phase difference in the air, corresponding to the length difference between the power supply cables, $\beta a$ denotes a propagation constant of the air, and $\Delta L_a$ denotes a height difference between the first radiator element and the second radiator element in the air, corresponding to the length difference between the power supply cables.

10. An antenna having radiator elements arranged on different planes, comprising:

a first-position radiator element placed at one plane;

a second-position radiator element placed at another plane; and power supply cables connected to the first-position radiator element and the second-position radiator element;

wherein lengths of the power supply cables are configured to compensate for a phase difference between signals radiated in the air from the first-position radiator element relative to the second-position radiator element by a phase difference between the power supply cables according to a position difference between the planes at which the first-position radiator element and the second-position radiator elements are placed;

wherein the first-position radiator element or the second-position radiator element is stacked on a patch-type radiator element of another frequency band, the patch-type radiator element having, a top patch plate and a bottom patch plate, wherein at least one corner of the top patch plate is bent.

11. An antenna having radiator elements arranged on different planes, comprising:

a first-position radiator element positioned at a lower plane;

a second-position radiator element positioned at an upper plane;

wherein the second-position radiator element is stacked on a patch-type radiator element operating at another frequency band; and the patch-type radiator element has a top patch plate and a bottom patch plate, and at least one corner of the top patch plate is bent.

12. The antenna of claim 11, wherein the top patch plate has four corners, and each of the four corners is bent.

* * * * *